US007712577B2

(12) United States Patent
Koss

(10) Patent No.: US 7,712,577 B2
(45) Date of Patent: May 11, 2010

(54) AIR INDUCTION HOUSING HAVING A PERFORATED SOUND ATTENUATION WALL

(75) Inventor: Julie A. Koss, Macomb, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 66 days.

(21) Appl. No.: 11/681,286

(22) Filed: Mar. 2, 2007

(65) Prior Publication Data

US 2008/0210188 A1 Sep. 4, 2008

(51) Int. Cl.
*F02M 35/12* (2006.01)

(52) U.S. Cl. ..... 181/229; 123/184.23

(58) Field of Classification Search ..... 181/229; 123/184.21, 184.23, 184.46, 184.57
See application file for complete search history.

(56) References Cited

U.S. PATENT DOCUMENTS

| | | | | |
|---|---|---|---|---|
| 4,236,597 | A | 12/1980 | Kiss et al. | |
| 4,326,865 | A * | 4/1982 | Siebels | 55/385.3 |
| 5,260,524 | A * | 11/1993 | Schroeder et al. | 181/229 |
| 5,679,931 | A | 10/1997 | Furse et al. | |
| 5,681,075 | A * | 10/1997 | Komori et al. | 296/192 |
| 5,696,361 | A | 12/1997 | Chen | |
| 5,979,598 | A | 11/1999 | Wolf et al. | |
| 6,105,716 | A * | 8/2000 | Morehead et al. | 181/255 |
| 6,662,892 | B2 * | 12/2003 | Falk et al. | 180/68.1 |
| 6,881,237 | B2 * | 4/2005 | Storz et al. | 55/385.3 |
| 2004/0011011 | A1 * | 1/2004 | Storz et al. | 55/385.3 |
| 2006/0032700 | A1 * | 2/2006 | Vizanko | 181/266 |

FOREIGN PATENT DOCUMENTS

JP 2003002292 A * 1/2003

OTHER PUBLICATIONS

"Acoustics of Ducts and Mufflers" by M. L. Munjal, John Wiley & Sons, New York, 1987; pp. 1, 46, 50-51, 147-150, and 298.
"Briggs and Stratton Air Filters" web catalog at http://www.mgindustrialengines.com/airfilters-briggs-stratton.html of MG Industrial Engines, Inc. of Seffner, FL 33584, 2 web pages (3 pdf print pages), believed dated before Mar. 2006. Filter products shown are examples of filters having a metal screen in front.
"Helmholtz Resonance" Wikipedia online encyclopedia, http://en.wikipedia.org/wiki/Helmholtz_resonance (Jan. 4, 2008).
"Airbox" Wikipedia online encyclopedia, http://en.wikipedia.org/wiki/Airbox (Sep. 14, 2007).
U.S. Appl. No. 12/057,401, filed Mar. 28, 2008, Inventor Julie Ann Koss.

* cited by examiner

*Primary Examiner*—Jeffrey Donels
*Assistant Examiner*—Jeremy Luks

(57) ABSTRACT

An air induction housing having a perforated wall which simultaneously provides ample air entry into the air induction housing and excellent intake noise attenuation. The size, number and arrangement of the perforations is selected such that ample airflow is provided and audibility of intake noise is minimized, based upon simultaneous optimization of: providing a plurality of perforations which collectively have an opening size that accommodates all anticipated airflow requirements; sizing each of the perforations such that the airflow demand involves an airflow speed through each perforation that is below a predetermined threshold at which perforation airflow noise is generated; and arranging the perforation distribution in cooperation with configuring of the air induction housing to provide a highest level of intake noise attenuation.

7 Claims, 6 Drawing Sheets

AIR INDUCTION HOUSING HAVING A PERFORATED SOUND ATTENUATION WALL

TECHNICAL FIELD

The present invention relates to air induction housings used in the automotive arts for air intake and air filtration for supplying intake air to an internal combustion engine. More particularly, the present invention relates to an air induction housing having a perforated wall for simultaneously providing air intake and sound (acoustic) attenuation.

BACKGROUND OF THE INVENTION

Internal combustion engines rely upon an ample source of clean air for proper combustion therewithin of the oxygen in the air mixed with a supplied fuel. In this regard, an air induction housing is provided which is connected with the intake manifold of the engine, wherein the air induction housing has at least one air induction opening for the drawing-in of air, and further has a filter disposed thereinside such that the drawn-in air must pass therethrough and thereby be cleaned prior to exiting the air induction housing on its way to the intake manifold.

Problematically, a consequence of the combustion of the fuel-air mixture within the internal combustion engine is the generation of noise (i.e., unwanted sound). A component of this noise is intake noise which travels through the intake manifold, into the air induction housing, and then radiates out from the at least one air induction opening. The intake noise varies in amplitude across a wide frequency spectrum dependent upon the operational characteristics of the internal combustion engine, and to the extent that it is audible to passengers of the motor vehicle, it is undesirable.

As shown at FIG. 1, a solution to minimize the audibility of intake noise is to equip an air induction housing 10 with an externally disposed resonator 12 connected to the air induction housing by an externally disposed snorkel 14. The air induction housing 10 has upper and lower housing components 16, 18 which are sealed with respect to each other, and are also selectively separable for servicing a filter media (not shown) which is disposed thereinside. An induction duct 20 is connected to the induction housing and defines an air induction opening 22 for providing a source of intake air to the air induction housing at one side of the filtration media, as for example by being interfaced with the lower housing component 18. An intake manifold duct 24 is adapted for connecting with the intake manifold of the internal combustion engine, and is disposed so as to direct the intake air at the other side of the filtration media out of the air induction housing 10, as for example via the upper housing component 16.

One end of the snorkel 14 is connected to the induction duct 20 adjacent the air intake opening 22. The other end of the snorkel 14 is connected to the resonator 12, which is essentially an enclosed chamber. Each end of the snorkel 14 is open so that intake noise may travel between the induction duct 20 and the resonator 12. The resonator 12 is shaped and the snorkel 14 configured (as for example as two snorkel tubes 14*a*, 14*b*) such that the intake noise passing through the induction duct toward the air intake opening in part passes into the resonator and then back into the induction duct so as to attenuate the intake noise by frequency interference such that the audibility of the intake noise exiting the air intake opening is minimized.

While the prior art solution to provide attenuation of intake noise does work, it does so by requiring the inclusion of an externally disposed snorkel and resonator combination which adds expense, installation complexity and packaging volume accommodation.

Accordingly, what is needed is to somehow provide attenuation of intake noise as an inherent feature of the air induction housing so as to thereby minimize expense, complexity and packaging volume.

SUMMARY OF THE INVENTION

The present invention is an air induction housing having a perforated wall which simultaneously provides ample air entry into the air induction housing and excellent intake noise attenuation, while attendantly minimizing expense and complexity of fabrication and assembly, as well as packaging volume.

The air induction housing having a perforated sound attenuation wall according to the present invention includes an air induction housing having an internally disposed filtration media, and is preferably characterized by mutually selectively sealable and separable housing components; an intake manifold duct interfaced therewith adapted for connection to the intake manifold of an internal combustion engine; and a perforated sound attenuation wall integrated with the air induction housing and characterized by a plurality of perforations formed of the air induction housing, itself. The air induction housing may be of any configuration and is suitably shaped to suit a particular motor vehicle application.

The size, number and arrangement of the perforations is selected, per the configuration of the air induction housing and the airflow requirements of the internal combustion engine, such that a multi-faceted synergy is achieved whereby: 1) ample airflow is provided through the perforations to supply the internal combustion engine with required aspiration over a predetermined range of engine operation, and 2) audibility of intake noise is minimized. The multi-faceted synergy is based upon simultaneous optimization of three facets: 1) providing a plurality of perforations which collectively have an area that accommodates all anticipated airflow (aspiration) requirements of a selected internal combustion engine; 2) minimizing the diameter while simultaneously adjusting the area of the perforations such that the airflow demand of the internal combustion engine involves an airflow speed through each perforation that is below a predetermined threshold at which the perforation airflow noise generated by the flow of the air through the perforations is acceptably inaudible; and 3) arranging the perforation distribution in cooperation with configuring of the air induction housing to provide a highest level of intake noise attenuation (i.e., minimal audibility).

A significant aspect of the present invention is that the intake noise attenuation is accomplished inherently by the air induction housing, itself, obviating need for any external components of any kind (as for example an external snorkel and resonator combination of the prior art).

Accordingly, it is an object of the present invention to provide an air induction housing having a perforated wall which simultaneously provides ample air entry into the air induction housing and excellent intake noise attenuation, while attendantly minimized are expense and complexity of fabrication and assembly, as well as packaging volume.

This and additional objects, features and advantages of the present invention will become clearer from the following specification of a preferred embodiment.

DESCRIPTION OF THE PREFERRED EMBODIMENT

Figure 1:
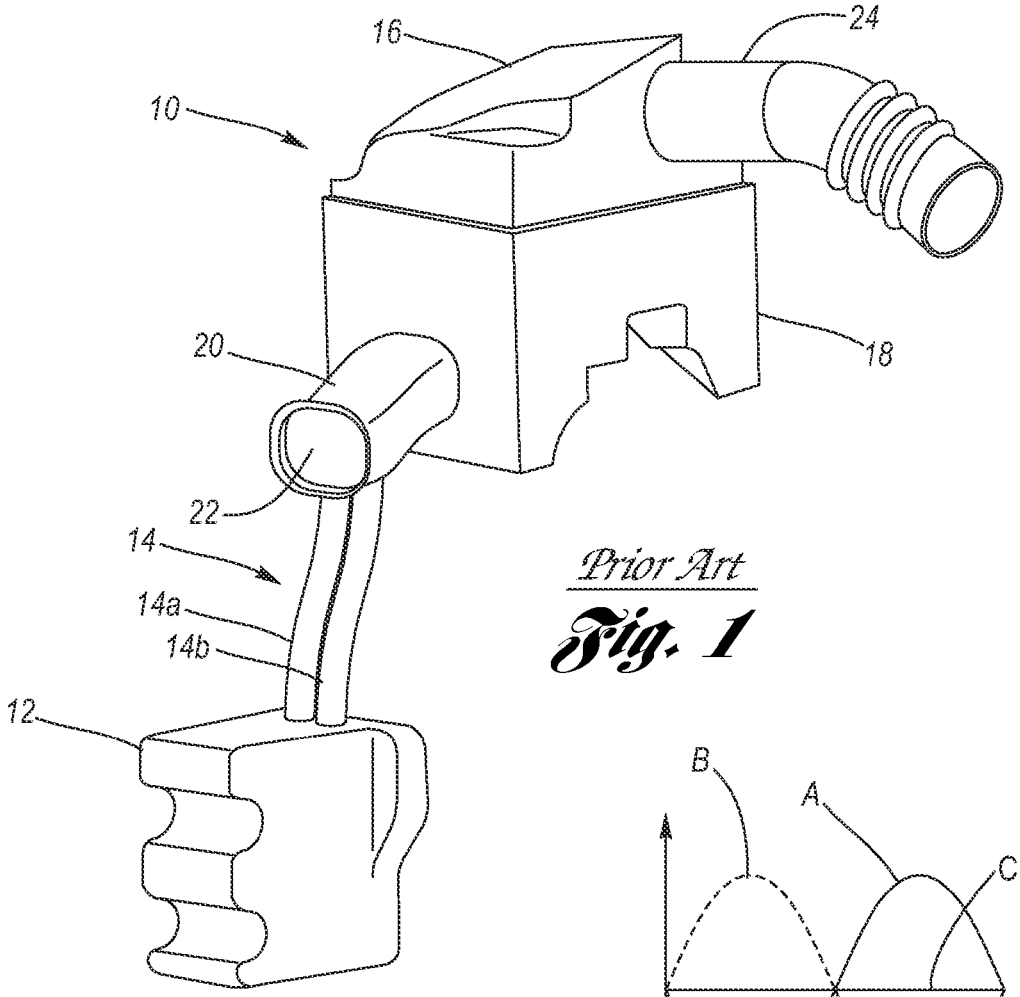
Prior Art Fig. 1
FIG. 1 is a perspective view of a prior art air induction housing including an external snorkel and resonator combination for attenuating intake noise.

Referring now to the Drawing, FIGS. 2A through 11 depict various aspects of an air induction housing having a perforated sound attenuation wall according to the present invention.

Figure 2A:
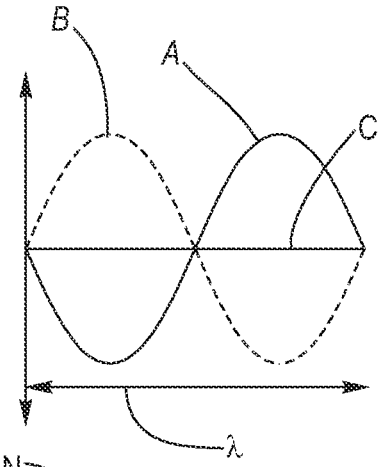
FIG. 2A is a graphical representation of two acoustic (sound) waves 180 degrees out of phase with respect to each other such that the acoustic waves are in destructive interference.
Figure 2B:
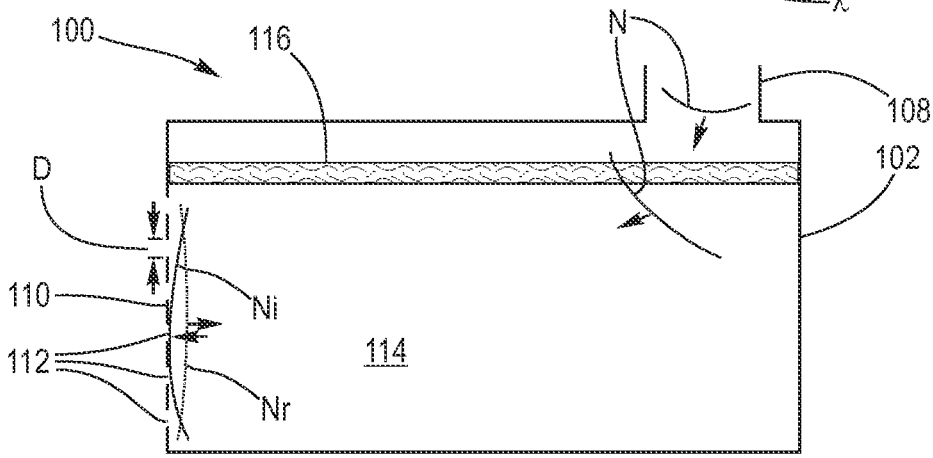
FIG. 2B is a schematic representation of how sound attenuation is believed to be provided by an air induction housing having a perforated sound attenuation wall according to the present invention.

FIGS. 2A and 2B show principles of physics under which it is believed an air induction housing having a perforated sound attenuation wall according to the present invention provides acoustic (sound) attenuation of intake noise, without resort to an external snorkel and resonator combination as used in the prior art.

FIG. 2A demonstrates the principle of destructive interference of acoustic (sound) waves. In this case, acoustic wave A is 180 degrees out of phase with acoustic wave B. As a result, if acoustic waves A and B have the same amplitude, then they completely cancel one another by destructive interference, the result being line C of zero amplitude.

Turning attention next to FIG. 2B, a schematic representation of air induction housing having a perforated sound attenuating wall 100 according to the present invention is depicted, including an air induction housing 102, an intake manifold duct 108 and a perforated wall 110 having a plurality of perforations 112 (holes or apertures) formed therein. Operationally, intake noise N from the engine passes into the air induction housing 102 via the intake manifold duct 108, enters into the interior space 114 of the air induction housing passing through a filtration media 116 disposed within the air induction housing, and strikes the perforated wall 110. The noise N strikes the perforated wall as an incident acoustic wave Ni, and is reflected as a reflected acoustic wave Nr which is 180 degrees out of phase with respect to the incident acoustic wave, whereby the incident and reflected acoustic waves mutually undergo destructive interference.

Further, under another principle, it is believed that to the extent the diameter D of the perforations 112 is less than any acoustic wave length $\lambda$ of the noise (see FIG. 2A), then these acoustic waves cannot exit the perforations. Accordingly, the level of sound emitted from the perforations exterior to the air induction housing 100 is acceptably inaudible to the occupants of the motor vehicle.

A mathematical theory believed to describe the foregoing description is as follows.

A reflection coefficient, R, is used to describe the ratio of the reflected wave to that of the incident wave (see *Acoustics of Ducts and Mufflers with Application to Exhaust and Ventilation System Design*, by M. L. Munjal, published by John Wiley & Sons, 1987:

$$R \equiv |R| e^{i\theta}, \tag{1}$$

where |R| and $\theta$ are the amplitude and phase of the reflection coefficient, respectively.

The amplitude and phase of the reflection coefficient at an opening, i.e., the perforations, is described by the following equations:

$$|R| \cong 1 - 0.14 k_o^2 r_o^2 \tag{2}$$

$$\theta = \pi - \tan^{-1}(1.2 k_o r_o), \tag{3}$$

where $k_o$ is an initial wave number in a non-viscous fluid (i.e., air) and $r_o$ is the radius of the enclosure (i.e., the air induction housing, itself).

From equations (2) and (3), it is determined that the perforations of the perforated wall reflect the incident acoustic wave (of the engine intake noise) almost fully but with opposite phase as a reflected acoustic wave. Therefore, very little sound is emitted from the perforations because the reflected acoustic wave and subsequent incoming acoustic wave cancel one another by destructive interference.

Further, given a diameter, D, of the perforations, and given a smallest acoustic wave length, $\lambda_{min}$, of the vast majority of the noise N, to the extent that $D < \lambda_{min}$, all the acoustic waves having $\lambda$ satisfying $\lambda_{min} < \lambda$ cannot exit the perforations. Accordingly, a minimum perforation diameter, D, is preferred.

However, a minimum diameter, D, of the perforations can produce noise as the airflow swiftly passes therethrough, as for example audibly detected as a howl, hiss or whistle. It is preferable that the Mach number, M, through the perforations be less than about 0.125, where M is defined by:

$$M = v/s, \tag{4}$$

where s is the speed of sound in air and v is defined by:

$$v = \Psi/(\rho A_P), \tag{5}$$

where Ψ is the maximum intake air mass flow rate of an internal combustion engine operational range divided by the number of perforations, ρ is the density of air, and $A_P$ is the area of each perforation.

Figure 3:
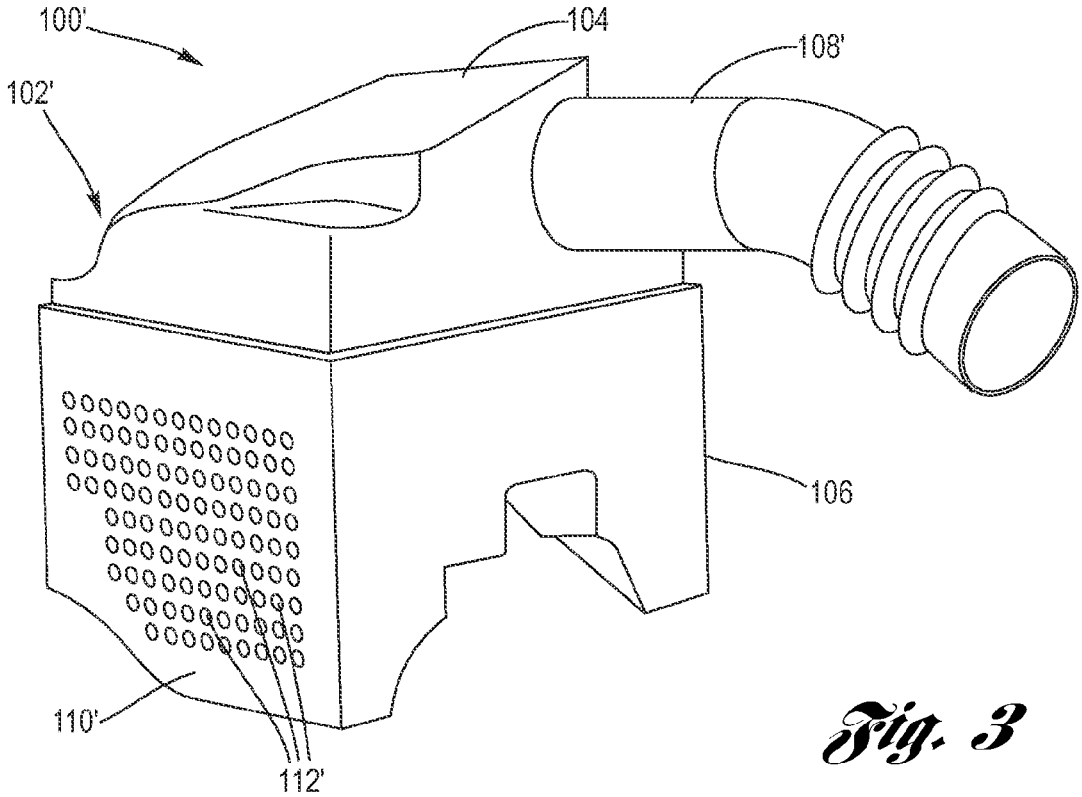
FIG. 3 is a perspective view of an air induction housing according to the present invention.
Figure 4:
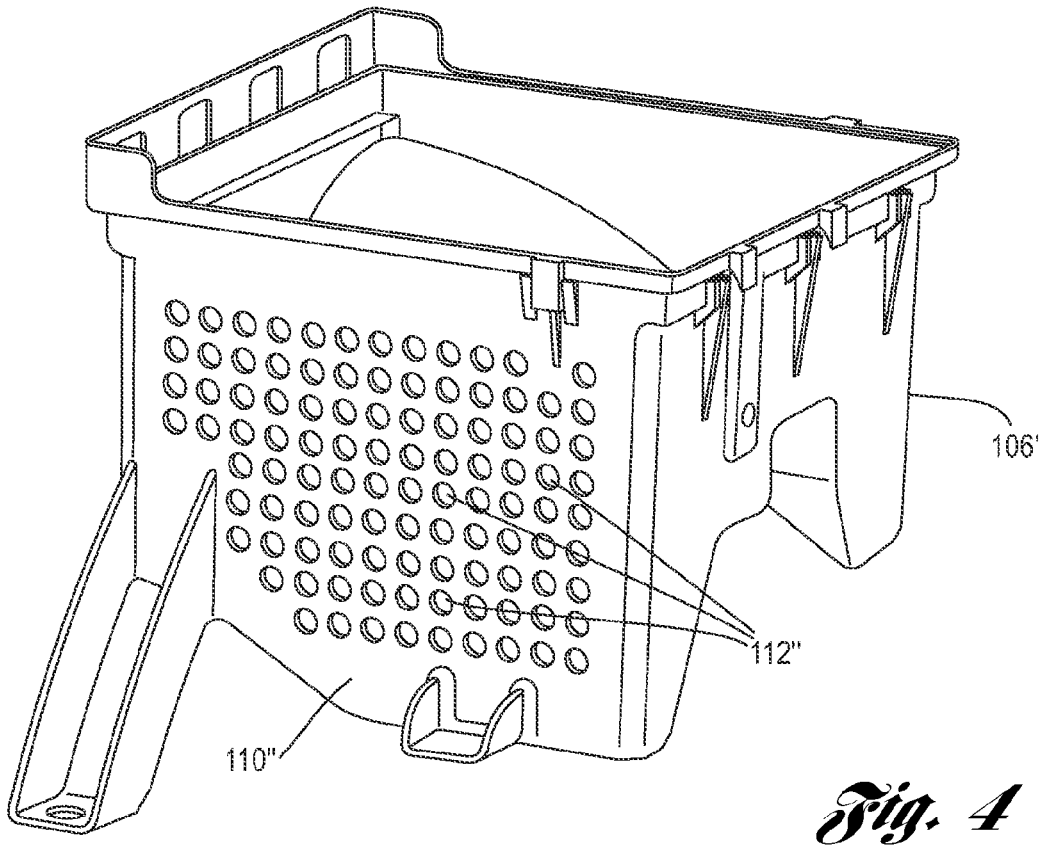
FIG. 4 is a perspective view of a lower housing component of an air induction housing having a perforated sound attenuation wall, which, in combination with the upper housing of FIG. 3, was analogously used for providing certain test plots in FIGS. 9 and 10.
Figure 5:
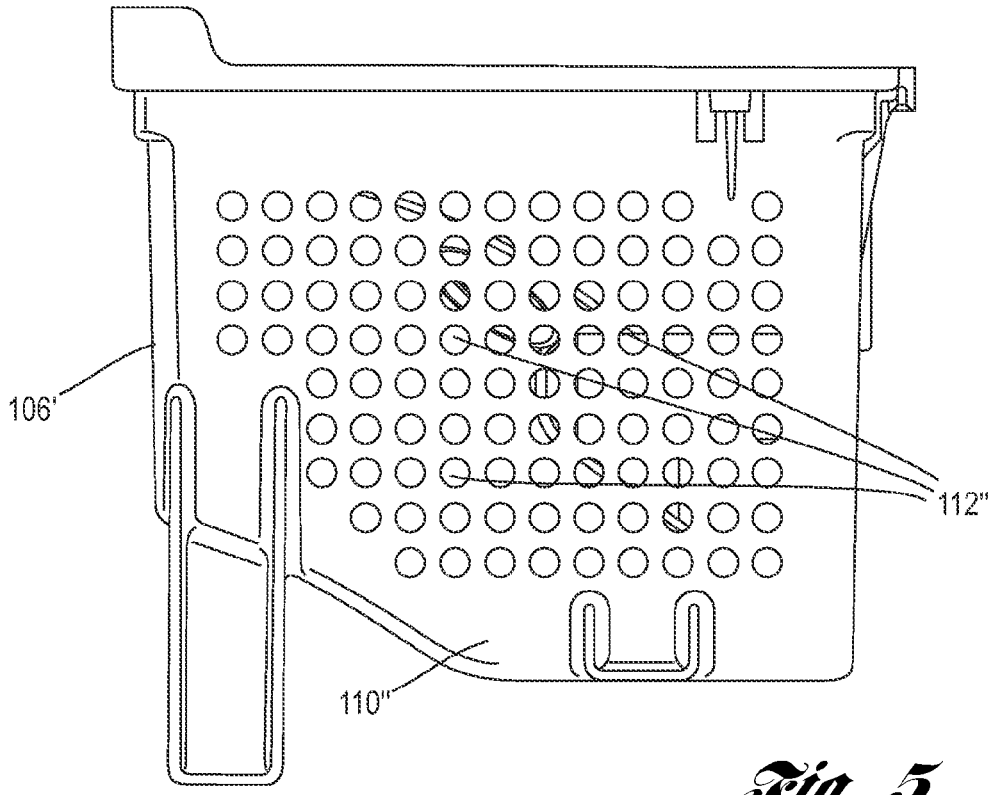
FIG. 5 is a front side view of the lower housing of FIG. 4.
Figure 6:
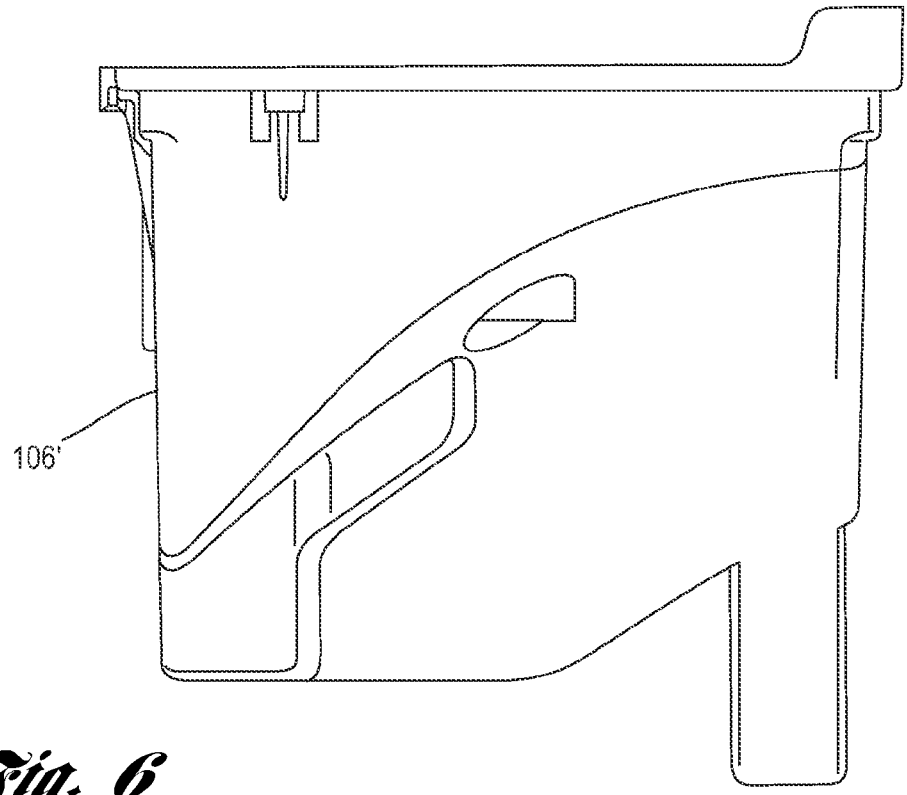
FIG. 6 is a rear side view of the lower housing of FIG. 4.
Figure 7:
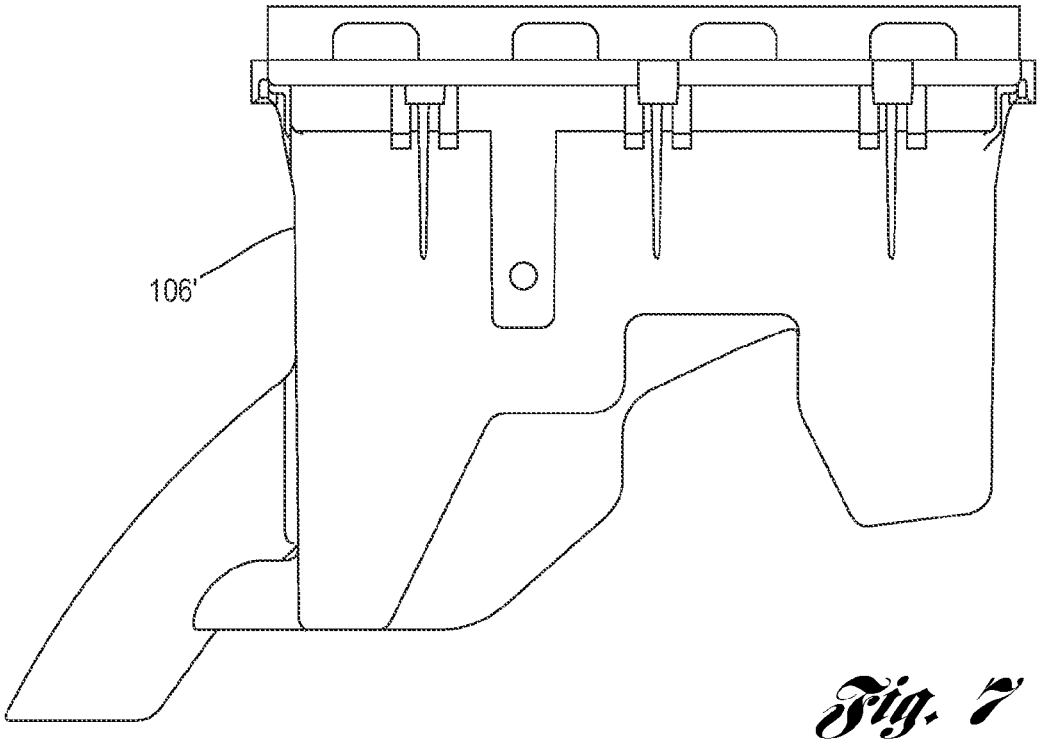
FIG. 7 is a left side view of the lower housing of FIG. 4.

Referring now to FIG. 3, an exemplary configuration of an air induction housing with a perforated sound attenuating wall 100' is depicted.

The air induction housing 102' has upper and lower housing components 104, 106 which are selectively sealable and separable with respect to each other (as for example via peripherally disposed clips) for servicing a filter media (not shown, but indicated at FIG. 2B) which is disposed thereinside. An intake manifold duct 108' is adapted for connecting with the intake manifold of an internal combustion engine, and its connection with the air induction housing is disposed so as to direct the intake air at one side of the filtration media out of the air induction housing 102', as for example via the upper housing component 104. A perforated wall 110' is integrated with the air induction housing, wherein the perforations 112' thereof collectively define an air induction opening for providing a source of intake air to the air induction housing 102' at the other side of the filtration media, as for example by being interfaced with the lower housing component 104.

Figure 8:
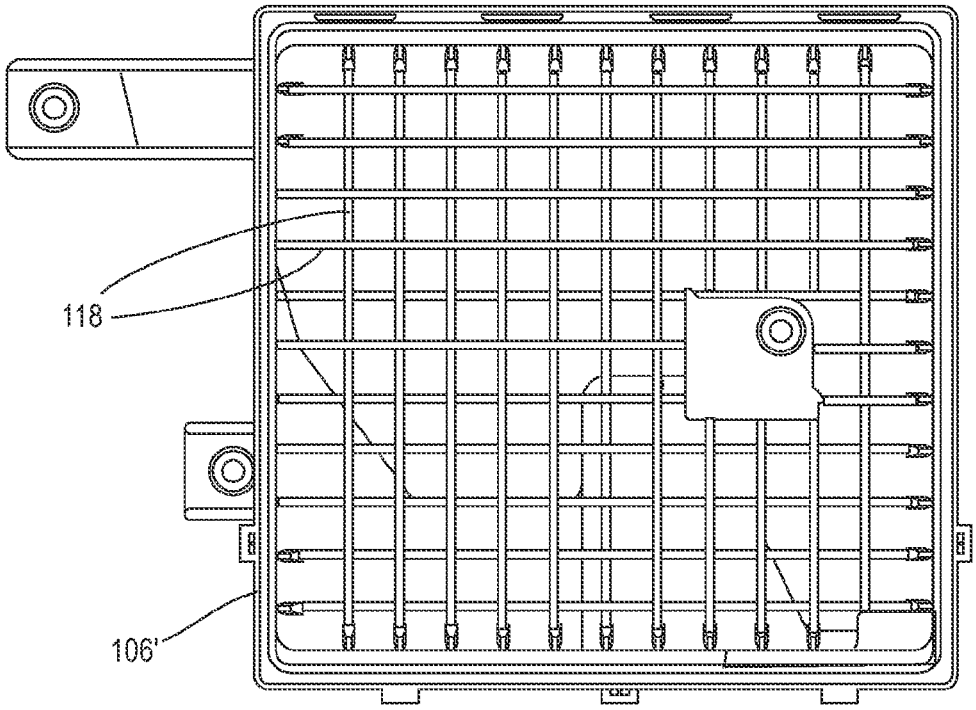
FIG. 8 is a top plan view of the lower housing of FIG. 4.

FIGS. 4 through 8 depict views of a lower housing component 106' of the induction housing of FIG. 3, having a perforated wall 110' and perforations 112', wherein FIG. 8 is a plan view showing internal ribbing features 118. The lower housing component 106' was interfaced with the upper housing component 104 of FIG. 3, and the perforations thereof varied in diameter, number and distribution from that shown for testing, the results of which are shown in Table I and at FIGS. 9 and 10.

Figure 9:
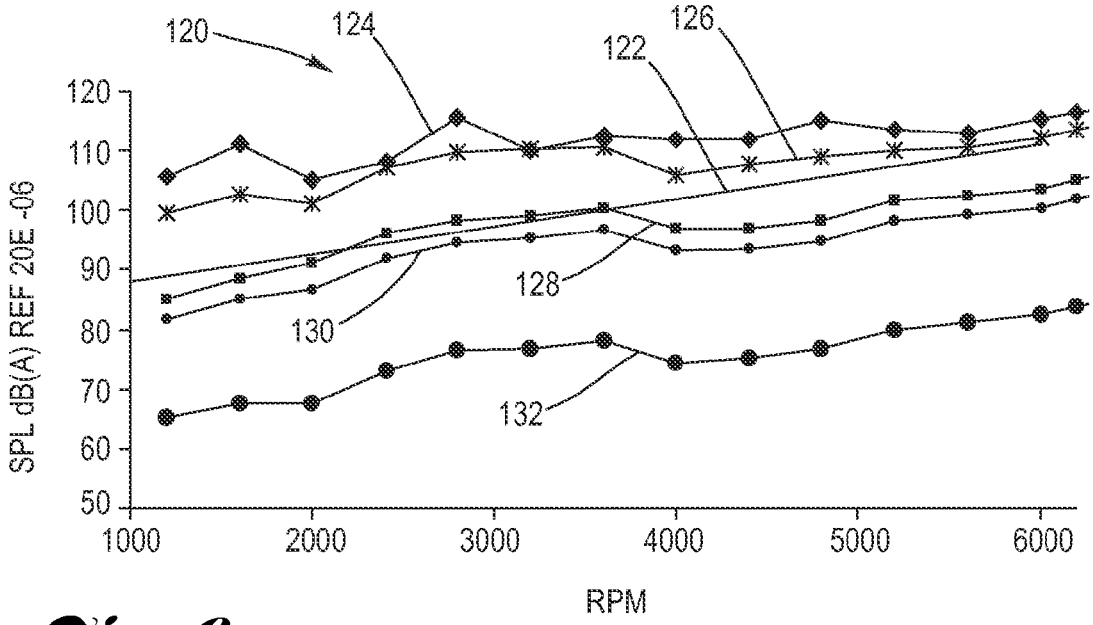
FIG. 9 is a graph of engine RPM versus sound level for several air induction housings according to the present invention per FIG. 3 and analogously per FIGS. 4 through 8, each having a selected perforated sound attenuating wall; for a prior art air induction housing with external snorkel and resonator combination per FIG. 1; and for an exemplar base line.

Turning attention to FIG. 9, a graph 120 of engine RPM versus emitted sound level of intake noise is shown. Plot 122 is a base requirement for sound emission. Plot 124 is the sound emitted by a prior art air induction housing with snorkel and resonator, as per that of FIG. 1. Plots 126, 128, 130, and 132 are for an air induction housing with perforated sound attenuating wall according to the present invention as per that of FIG. 3 and analogously per that of FIGS. 4 through 8, wherein plot 126 is for 10 circular perforations each of 27.5 mm diameter, plot 128 is for 103 circular perforations each of 10 mm diameter, plot 130 is for 200 circular perforations each of 7.2 mm diameter and plot 132 is for 10,000 circular perforations each of 1.02 mm diameter. It is seen that the present invention provides low sound level emission, in each plot better than the prior art, and better than the base line requirement. Further the best result is seen to be provided with the smallest diameter perforations.

Figure 10:
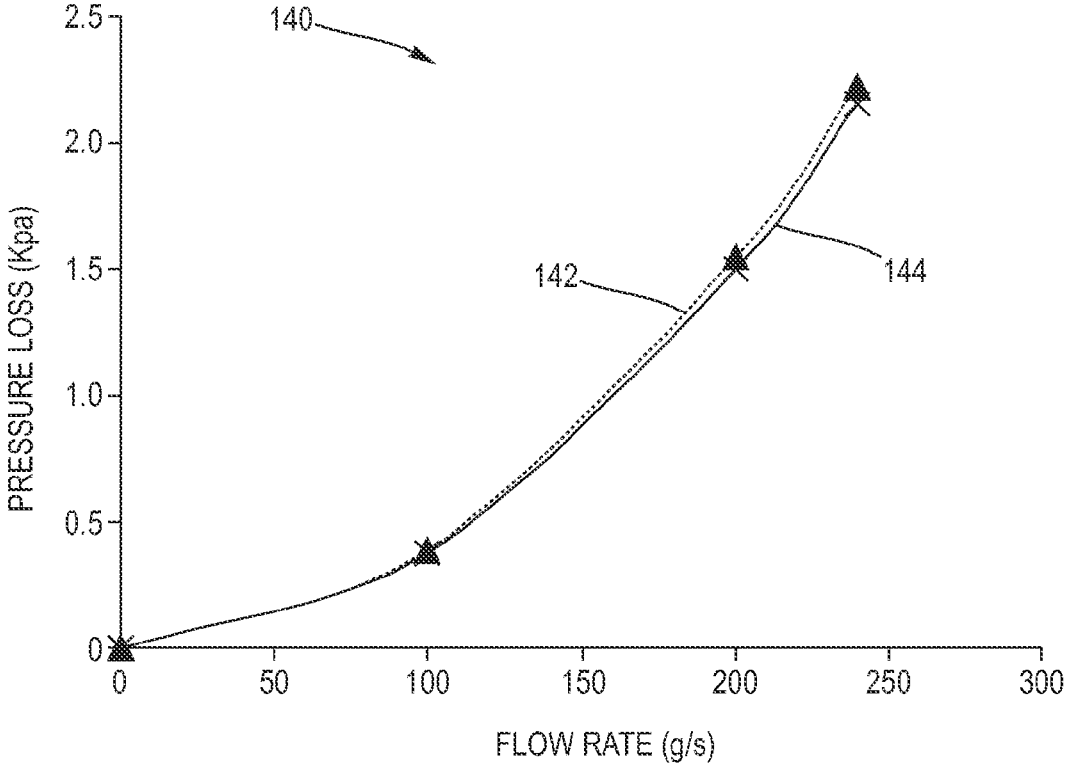
FIG. 10 is a graph of airflow rate versus air pressure loss for a prior art air induction housing with external snorkel and resonator combination per FIG. 1, and for an air induction housing having a perforated sound attenuating wall according to the present invention per FIG. 3 and analogously per FIGS. 4 through 8.

Turning attention next to FIG. 10, a graph 140 of airflow rate versus air pressure loss is shown. Plot 142 is for a prior art air induction housing with snorkel and resonator as per that of FIG. 1, and plot 144 is for an air induction housing with perforated sound attenuating wall according to the present invention as per that of FIG. 3 and analogously per that of FIGS. 4 through 8, having 73 perforations. It will be seen the results are comparable, whereby it is interpreted that the present invention provides air pass-through that is better than the prior art.

Table I shows data taken for various internal combustion engines, various selected perforation numbers and diameters for each engine, and the resulting Mach numbers associated with each of the perforation diameters and numbers selected.

TABLE I

| Engine Type | Inlet area ($mm^2$) (per best practice) | Perforation diameter (mm) | Number of perforations | Flow Rate (g/s) | Mach Number |
|---|---|---|---|---|---|
| 4 cylinder | 2968 | 5 | 152 | 140 | 0.111 |
| | | 10 | 38 | | 0.111 |
| | | 15 | 17 | | 0.111 |
| | | 20 | 10 | | 0.106 |
| | | 30 | 5 | | 0.094 |
| | | 40 | 3 | | 0.088 |
| | | 50 | 2 | | 0.085 |
| 6 cylinder | 5959 | 5 | 304 | 240 | 0.095 |
| | | 10 | 76 | | 0.095 |
| | | 15 | 34 | | 0.095 |
| | | 20 | 19 | | 0.096 |
| | | 30 | 9 | | 0.090 |
| | | 40 | 5 | | 0.091 |
| | | 50 | 3 | | 0.096 |
| 8 cylinder | 8247 | 5 | 420 | 300 | 0.086 |
| | | 10 | 105 | | 0.086 |
| | | 15 | 47 | | 0.086 |
| | | 20 | 27 | | 0.084 |
| | | 30 | 12 | | 0.084 |
| | | 40 | 7 | | 0.081 |
| | | 50 | 5 | | 0.073 |
| 8 cylinder high performance engine | 8247 | 5 | 420 | 450 | 0.129 |
| | | 10 | 105 | | 0.129 |
| | | 15 | 47 | | 0.129 |
| | | 20 | 27 | | 0.126 |
| | | 30 | 12 | | 0.126 |
| | | 40 | 7 | | 0.121 |
| | | 50 | 5 | | 0.109 |

It is seen from Table I that a wide range of perforation diameters can achieve a desired small Mach number. It is to be further noted that, per the above theoretical discussion, for purposes of acoustic (sound) attenuation, the smaller the perforation diameter the better. However, as mentioned hereinabove, it is necessary to adjust the area of the perforations so that the airflow (more specifically, the maximum airflow demanded of the internal combustion engine) passing through the perforations does not, itself, create undesirable noise, wherein it is preferred that the Mach number be under about 0.125 in order to achieve this result.

Thus, from Table I, it is possible to find best perforation parameters (by "best" is meant relative to the test results summarized in Table I, in that other tests may provide other "best" results): for the 4 cylinder engine is a perforated wall having 152 perforations of 5 mm diameter and having a Mach number equal to 0.111, best for the 6 cylinder engine is a perforated wall having 304 perforations of 5 mm diameter and having a Mach number equal to 0.095, best for the 8 cylinder engine is a perforated wall having 420 perforations of 5 mm diameter and having a Mach number equal to 0.086. The best for the high performance 8 cylinder engine may be a perforated wall having 420 perforations of 5 mm diameter and having a Mach number equal to 0.129, in that a Mach number of 0.129 may be acceptable (as empirically ascertained) in that engine application.

Figure 11:
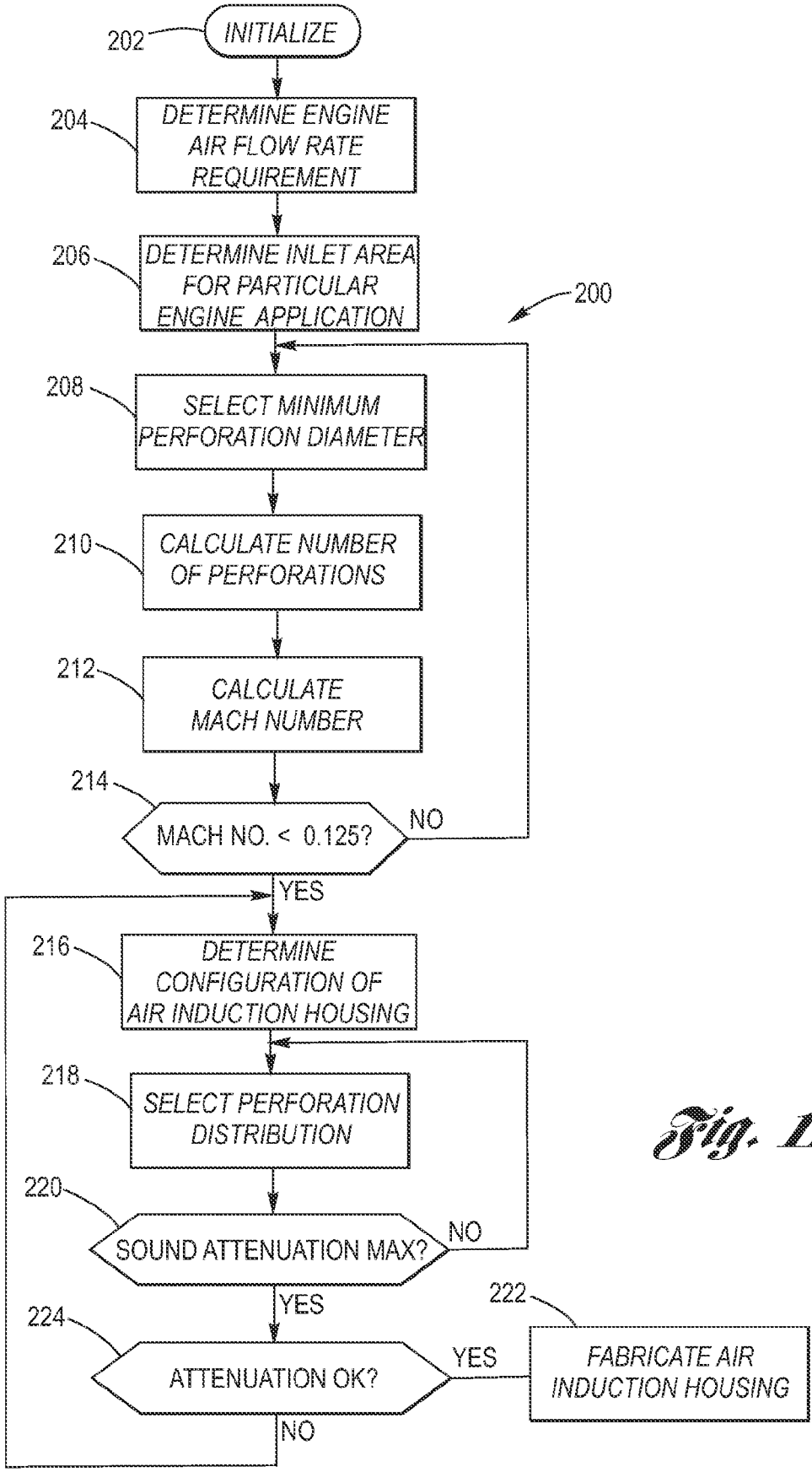
FIG. 11 is a flow chart of an algorithm for optimizing acoustic attenuation of intake noise by the air induction housing having a perforated sound attenuating wall according to the present invention.

Turning attention now to FIG. 11, depicted are the steps associated with an algorithm 200 for expositing a method for optimizing the air induction housing with a sound attenuating perforated wall according to the present invention.

At Block 202, the algorithm is initialized. At Block 204, the engine airflow rate requirement of a selected internal combustion engine is determined. At Block 206, the necessary inlet area, $A_I$, is determined such that back pressure is not an issue for the operation of the internal combustion engine, per the determination at Block 204. Once this area is determined, preferably about one percent (1%) is added thereto in order to account for entrance/exit airflow losses. This inlet area is the starting point for determining the number of perforations (based on average perforation area) of the perforated wall of the air induction housing.

Next, at Block 208, a minimum perforation diameter is selected using an empirical best estimation to provide a perforation area, $A_P$. Next, at Block 210, the number, n, of perforations is calculated, wherein $n=A_I/A_P$. The smaller the perforation diameter, the better the noise attenuation benefit, as there are more waves reflected back into the box, as discussed hereinabove. However, the minimum area (and therefore diameter) of the perforations is limited by the Mach number, M, of the airflow through the perforations when at the maximum airflow rate, as discussed hereinabove.

Next, at Block 212, the Mach number, M, for the airflow through the perforations when at the maximum mass flow rate is calculated using, for example, equations (4) and (5). At Decision Block 214, inquiry is made whether the Mach number is less than, by way of preference, about 0.125. If the answer to the inquiry is no, then the algorithm returns to Block 208, whereat a new minimum perforation diameter is selected, larger than that previously selected (that is, assuming the first chosen minimum diameter was a true minimum, otherwise various larger and smaller diameters can be tried to find the minimum). However, if the answer to the inquiry is yes, then the algorithm advances to Block 216.

At Block 216, the configuration of the air induction housing is determined. In so doing, taken into account are the packaging requirements for accommodation within the engine compartment, as well as a best estimation for providing acoustic attenuation, for example, per equations (2) and (3). The shape may be any suitable and/or necessary shape, as for example an irregular polygonal shape as for example shown at FIGS. 3 through 8, a regular polygonal shape, spherical shape, cylindrical shape, pyramidular shape, or some combinational shape thereof, etc. Next, at Block 218, a distribution of the perforations is selected based upon an empirical best estimate. The spacing between the perforations should be maximized to ensure the best possible wave reflection (and thus sound attenuation). The spacing between the perforations is limited by the air induction housing size, per the number of perforations and the perforation area.

Next, at Decision Block 220, inquiry is made, for example by use of empirical testing of a modeled air induction housing, whether the sound attenuation is a maximum (i.e., sound emission at the perforations is a minimum). If the answer to the inquiry is no, then the algorithm returns to Block 218, wherein any possible reconfiguration of the air induction housing is made (if packaging constraints allow), and the perforation distribution is again reselected. However, if the answer to the inquiry at Decision Block 220 is yes, then the algorithm advances to Decision Block 224.

At Decision Block 224, inquiry is made whether the amount of sound attenuation is acceptable based upon a predetermined base line (as for example plot 122 of FIG. 9). If the answer to the inquiry is no, then the algorithm returns to Block 216 to continue optimization of sound attenuation. However, if the answer to the inquiry at Decision Block 224 is yes, then fabrication of an air induction housing with a sound attenuating perforated wall according to the present invention may be performed with confidence.

It is to be understood that the perforations may have any shape or differing shapes, any area or differing areas, any diameter or differing diameters, and have uniform or non-uniform spacing therebetween, the perforated wall may be located anywhere or generally everywhere of the air induction housing, and that multiple layers of the perforated wall my be utilized, all for the purpose of tuning the intake noise emitted from the air induction system to a desired level of attenuation (acceptably inaudible) at the perforations.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. An air induction housing for providing an airflow to an internal combustion engine and sound attenuation of engine intake noise, the internal combustion engine requiring a predetermined maximum airflow rate, said air induction housing comprising:

a housing having a predetermined configuration, said housing comprising a perforated wall free of covering, wherein a plurality of perforations are formed in said perforated wall, said plurality of perforations collectively providing a predetermined intake opening size for said housing, said housing further comprising an engine air intake connection, wherein all of the airflow to the engine intake connection passes exclusively through said plurality of perforations;

each perforation of said plurality of perforations has an area and said plurality of perforations has a distribution selected in relation to said configuration which, in combination, reflects the engine intake noise interior to said housing; and the airflow through the area of each said perforation is less than substantially Mach 0.125 at the maximum airflow rate of the internal combustion engine.

2. The air intake housing of claim 1, wherein said intake opening size has an area, $A_I$, said plurality of perforations each have an average area, $A_P$, and wherein the number, n, of said perforations is $n=A_I/A_P$.

3. The air intake housing of claim 2, wherein said number, n, of said perforations ranges substantially between 10,000 and 5; and wherein each said perforation has an average diameter of substantially between 1 and 50 millimeters.

4. The air induction housing of claim 3, wherein said number, n, ranges substantially between 420 and 10.

5. The air intake housing of claim 3, wherein said distribution provides a maximum spacing between adjacent perforations limited by said predetermined configuration.

6. The air intake housing of claim 3, wherein said area of said perforations further comprises said perforations each having a minimum diameter.

7. The air intake housing of claim 6, wherein said distribution provides a maximum spacing between adjacent perforations limited by said predetermined configuration.

* * * * *